United States Patent [19]

Nakamura

[11] Patent Number: 4,827,585

[45] Date of Patent: May 9, 1989

[54] CAM SHAFT MANUFACTURING METHOD AND DEVICE USED THEREIN

[75] Inventor: Masanobu Nakamura, Kamakura, Japan

[73] Assignees: Mitsui & Co., Ltd., Tokyo; Kokan Kako Co., Ltd., Yokohama, both of Japan

[21] Appl. No.: 124,624

[22] Filed: Nov. 24, 1987

[30] Foreign Application Priority Data

Feb. 10, 1987 [JP] Japan ..... 62-28880

[51] Int. Cl.[4] ..... B21D 39/00

[52] U.S. Cl. ..... 29/156.4 R; 29/523; 29/421.1; 29/757; 29/760

[58] Field of Search ..... 29/156.4 R, 421 R, 433, 29/444, 507, 523, 757, 760; 72/58, 61, 62

[56] References Cited

U.S. PATENT DOCUMENTS 4,597,365 7/1986 Madaffe ..... 29/156.4 R X
4,708,029 11/1987 Urano ..... 29/421 R X
4,738,012 4/1988 Hughes et al. ..... 29/156.4 R

*Primary Examiner*—Timothy V. Eley
*Attorney, Agent, or Firm*—Spencer & Frank

[57] ABSTRACT

A method and an apparatus for manufacturing cam shafts in which cam members are held in respective rotatable axially aligned rings by holding members connected within the rotatable rings so that a pipe member cam be inserted through respective aligned holes of the cam members. The rings are individually rotatable so as to rotate the cam members by respetive predetermined angles. After a pipe member is inserted in the holes of the individually rotated cam members, a bulging process device seals respective opposite ends of the pipe member and forces a pressurized fluid into the pipe so as to bulge the pipe to fix the pipe in the respective holes, thereby to form the cam shaft.

12 Claims, 3 Drawing Sheets

CAM SHAFT MANUFACTURING METHOD AND DEVICE USED THEREIN

BACKGROUND OF THE INVENTION

This invention relates to a method of manufacturing a cam shaft for driving intake/suction valves in an internal combustion engine of automobiles, motor cycles, etc. and a device used therein.

In the internal internal combustion engine of an automobile, etc. cam shafts are used to open/close valves in intake/suction systems of cylinders with predetermined timing.

These cam shafts were heretofore manufactured by a casting or forging process which formed a cam, a journal, and a shaft integrally. These cam shafts were therefore inevitably heavy in weight, thus presenting a bottleneck in efforts to reduce overall engine weight. In order to overcome the problem, there has been proposed a manufacturing device which is characterized in that engaging projection/recess members are provided oppositely in order to determine the angle of each cam member so that the cam member can be manufactured to have a predetermined angular relation (Japanese patent application laid-open Sho 51-5415). In the proposed process, a hollow pipe which is a material of a shaft member is attached on the outside thereof with a cam member, and is fixed therewith by the bulging process. The engaging projection/recess members are provided on respective cam members as well as on at least the lower die of the split dies which are used for holding the cam member and for the bulging process.

However, the above device is disadvantageous in that it requires specific split dies with engaging members, and the structure of a split die is extremely complicated. Further, as different types of engines require dedicated split dies, different split dies have to be prepared especially for all the models, to thereby push up the cost.

There has also been known another method which can position a cam member by fitting a hollow shaft material which is shaped like a prism with a regular polygonal section into a square hole of the cam member, the square hole of a cam member being bored in advance at a predetermined phase angle (Utility Model Publication Sho 53-7130).

However, the cam members had to be bored to have the square holes with an extremely high precision in the proposed process to thereby present difficulties in the manufacturing process.

OBJECTS AND SUMMARY OF THE INVENTION

This invention aims to obviate these problems encountered in the prior art, and to provide a method of manufacturing cam shafts and a device used therein which can manufacture cam shafts of various types without the need to bore square holes at a high precision not or use complicated split dies.

This method is the manufacturing process comprising a steps of:

(a) arranging a predetermined number of cam members, (b) conveying the arranged cam members to respective rotating rings at one time, (c) holding the cam members on the projections thereof with holding means connected to the rotating rings, (d) positioning the cam members to have a predetermined phase angle relative to each other by rotating the holding means with the rotating rings at a predetermined angle, (e) inserting a pipe member penetratingly through the holes of the cam members, and (f) sealing both ends of the pipe member, forcing fluid into the pipe member under pressure, and fixing the cam members onto the outer periphery of the pipe member by the bulging process. A device for use in performing the method includes plural rotating rings provided on a common axis, holding means connected to the rotating rings which can expand/contract lengthwise with regard to cam members, a rotating means which can rotate said rotating rings individually at a predetermined rotating angle, and a bulging process device which can seal both ends of a pipe member inserted into each cam member and force pressured fluid thereinto.

With a structure formed of the aforementioned components, the method of the invention can be used to manufacture cam shafts suitable for various types of engines by using a single device and by suitable rotating the rotating rings by a ratating means.

DETAILED DESCRIPTION OF PREFERRED EMBODIMENTS

This invention will now be described in further detail referring to the embodiments shown in the attached drawings.

Figure 1:
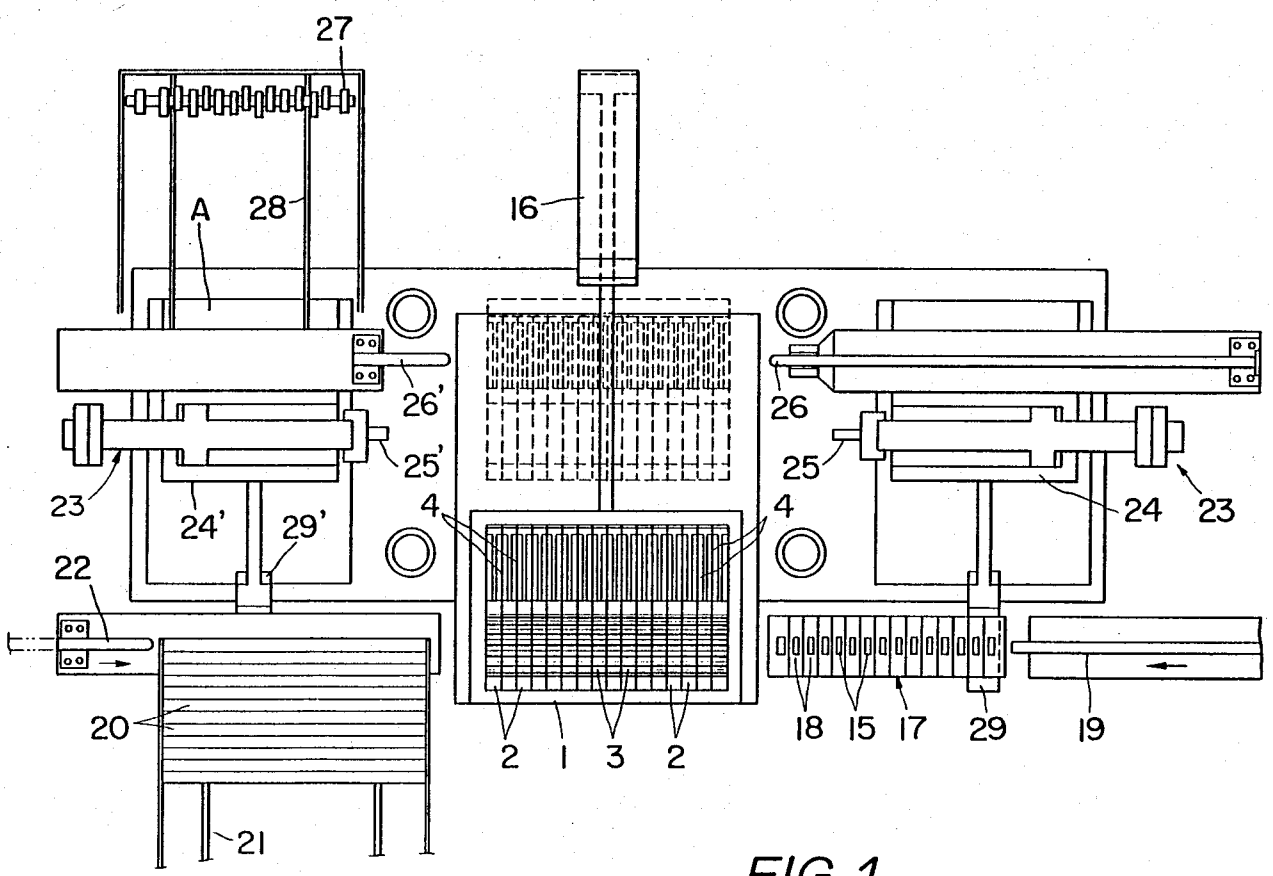
FIG. 1 is a plan view of an embodiment of the device according to this invention.

FIG. 1 shows an example of the arrangement of the component parts suitably arranged for practical operation of this invention wherein plural rotating rings 2 are aligned coaxially on a base 1 at the center. The rings 2 have gears on the outer peripheries thereof in the shown embodiment so that they are engaged with racks which are slidably mounted on the base 1.

Figure 2:
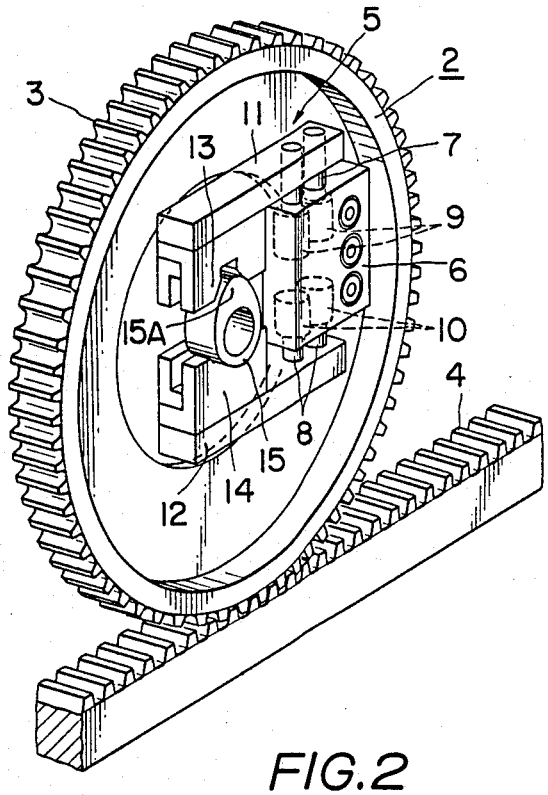
FIG. 2 is a perspective view to show a rotating ring shown in FIG. 1.
Figure 3:
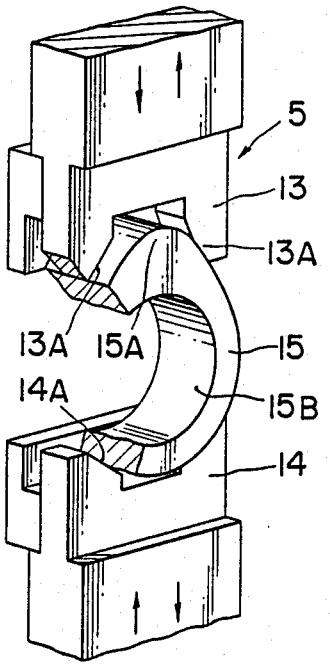
FIG. 3 is an enlarged perspective view showing the holding section of a holding means for cam members.
Figure 4:
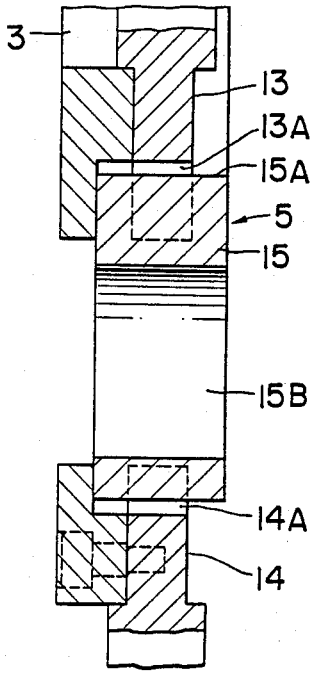
FIG. 4 is a longitudinal section thereof.
Figure 5:
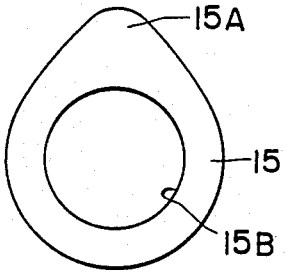
FIG. 5 is a frontal view of an example of the cam member.

A respective cam member holding means 5 is mounted inside each of the rotating rings 2 in a manner that the holding means can synchronously rotate with the rotating rings 2. As shown in FIGS. 2 through 4, the holding means 5 comprises a block 6 fixed inside the ratating ring 2, fluid cylinders 9,10 provided inside the fixed block 6 and moving piston rods 7,8 disposed in parallel but extending in opposite directions, vertically spaced apart supporting arms 11,12 which are respectively connected to the rods 7,8, and holding members 13,14 which are respectively provided on the opposed faces of supporting arms 11,12.

The holding members 13,14 have recesses generally in the form of the letter V with diverging sloped surfaces 13A,14A so that they can firmly hold a projection 15A and a circumferential surface opposite to the projection 15A of a cam member 15. When the projection 15A of the cam member is held therein, the two sides of the projection can be positioned in laterally symmetrical positions with the sloped surfaces 13A,14A to achieve alignment of the center of the projection 15A with the center of the holding member 13.

The base 1 can be moved from the position shown in full lines to the position shown in broken lines in FIG. 1 by a driving means such as air cylinders 16 or piston rods, etc.

A table 17 is installed along the same axial line as the rotating rings 2 and at one side of the base 1 for setting the cam members, and on the upper surface thereof are formed cam member mounting sections 18 in the form of a recess for vertically mounting the cam members 15 individually at predetermined equal intervals.

By arranging the cam members 15 on the sections 18 with the projections thereof facing upward, the cam members can singly be arranged to have their holes 15B in axial alignment.

On an adjacent side of the table 17 is provided a feeding rod 19 for the cam members which can be moved in the direction indicated by an arrow with a driving means (not shown) such as fluid cylinders in such a manner that the feeding rod 19 can penetrate the holes 15B of the cam members 15. The rod 19, which is not illustrated in detail, should preferably be structured so as to ensure fast holding of the cam members 15 by alternatively increasing and reducing the outer diameter thereof.

On the other side of the base 1 to oppose the table 17 are provided a chute 21 for supplying pipe members 20 which form shafts and of the cam shafts, pipe forcing rods 22 which are installed at one end of the chute 21 to force the pipe member 20 into the holes 15B of the cam members 15 which are being supported by the holding means 5 of the rotating rings 2 the pipe member 20 being arranged on the same axial line as the holes 15B. On both sides of the base 1 are provided bulging process devices 23 in parallel to the table 17 for setting the cam members.

Similarly to the prior art devices the bulging process devices 23 comprise a pair of cylinders 24,24', and upper and lower holding dies (not shown), and are structured to have the ends of rods 25,25' of the cylinders 24,24' closely attached onto the ends of the pipe members 20 inserted through the cam members 15 so that fluid (e.g. water) may be forced into the pipe members 20 through fluid paths (not shown) on the rods 25,25'.

Product outlet rods 26,26' are installed adjacent to the bulging process devices 23 to oppose each other across an adjustable space so that they can hold both ends of a cam shaft when completed with ends thereof, and move the cam shaft 27 to a discharging position A.

At the position A is installed a receiving table 28 to receive cam shafts 27 as they are completed.

The reference numerals 29,29' denote cylinders which translate the product outlet rods 26,26' and the bulging process devices 23.

The method of manufacturing cam shafts using the device which is structured as above will now be described. Pipe members 20 are supplied on the chute 21, and cam members 15 are placed with their projections 15A facing upward on the sections 18 of the table 17.

Then, the feeding rod 19, whose radial dimensions can be expanded and contracted, is advanced the left of FIG. 1 to penetrate the holes 15B of the cam members 15 arranged on the table 17, and the diameter of the rod 19 is increased to thereby firmly hold the cam members 15.

Then, the rod 19 is advanced further to the left so as to move respective cam members 15 to the holding means 5 of the corresponding rotating rings 2.

The cam member 15 is automatically positioned by the alignment of the projection 15A with the sloped portions 13A of the holding member 13, and then is held from above and underneath. The diameter of the rod 19 is then reduced, and the rod 19 is pulled out of the hole 15B of the cam member to leave the cam members 15 in a state where they are held firmly with the holding means 5 of the rotating rings 2.

The rotating rings 2 are rotated by a predetermined angle so that the projections 15A have a predetermined angular relation to each other. The rings 2 can be rotated by moving the racks 4 with which the gears 3 on the peripheries of rings are engaged. More particularly, by moving respective racks 4 the rotating rings 2 are rotated via the gears 3, and the cam members 15 which are held by the holding means 5 are rotated synchronously to thereby adjust the angular relation between cam members 15,15 . . . .

As the number of gears on the rotating rings in this embodiment is 64, they can be rotated by ca. 5.6° per pitch. If the number of gears is 120, they can be rotated by 3°. Naturally, if the backlash between the gears 3 and the rack 4 is diminished, the rotation can be made by an angle smaller than 3°.

After having adjusted the angular relation among cam members 15, the rod 22 is advanced to the right in FIG. 1, and a pipe member 20 at the end of chute 21 is inserted to penetrate the holes 15B of the members 15.

After the insertion of the pipe member 20, the base 1 of the ring 2 is moved to the position shown in broken lines in FIG. 1 by actuating the cylinder 16, then the cylinders 24,24' for the bulging process device 23 is actuated, and the rods 25,25' are forcibly attached on the ends of the pipe member 20. The pipe member 20 is held by the metal molds in the portions which are not in contact with the cam members.

Then, fluid is forced into the pipe member 20 from the rods 25,25' via fluid paths (not shown) to bulge the pipe 20 against the inner peripheral surfaces of the holes 15B of the cam members 15 for fixation.

After fixing the cam members 15 the pipe members 20 are released from the holding means 5 and the metal molds, the rotating rings 2 are moved to the position of the product outlet rods 26,26', the rods 26,26' are advanced to hold both ends of the pipe member 20 and then are moved to the outlet position A to release the pipe 20, and the completed cam shaft 2 is discharged fto the receiving table 28.

Then the rotating rings 2 are moved downward in the figure to repeat the aforementioned steps in the manufacturing process for the cam shafts 27.

Figure 6:
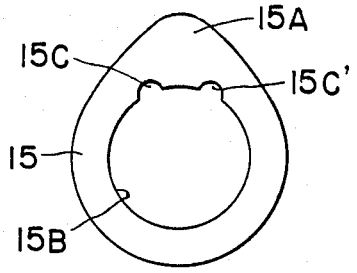
FIG. 6 is a frontal view of a modified example of the cam member.

In fixing the pipe member 20 with the cam members 15,15 . . . , if recesses 15C,15C are formed beforehand on the inner peripheral surfaces corresponding to the projections 15A within the holes 15B of the cam members 15 as shown in FIG. 6, so that the pipe 20 is deformed and forced into the recesses 15C,15C, then the pressure of the fluid can be reduced to a certain extent in the bulging process.

Although not illustrated, a large number of grooves may be formed axially either on the outer peripheral surface of a pipe member 20 or the inner peripheral surface of a hole 15B, or the hole 15B per se may be formed in a polygonal shape to ensure the attachment.

As shown in the figures, gears 3 may be provided on the outer periphery of a rotating ring 2, and the ring 2 is rotated by moving a rack 4, thereby attaining a precise rotational angle easily. If a stopper is further provided on a part of the rack 4, the stopping position of the rotating ring 2 may be controlled very conveniently.

The rotating means for the rings 2 is by no means limited to the one used in the above embodiment, but may be any arbitrary rotating means.

If extremely high precision is required in the manufacture, a rotary table which can rotate the ring by 0.1° should be used.

As described in detail in the foregoing statement, the method of manufacturing cam shafts and the device for performing the method, according to this invention can adjust and set phase angles between cam members simply by rotating the rotating rings. This invention can therefore produce cam shafts suitable for all types of engines using only one device and can be applied in a wide variety of fields.

This method and device do not neet complicated split dies nor boring at a high precision a hole on a cam member, thereby enhancing workability and reducing the cost of the process.

What is claimed is:

1. A method for manufacturing cam shafts comprising the steps of (a) providing a predetermined number of cam members having respective projections and having respective holes therein, the holes being aligned with each other, (b) conveying the cam members together, with the holes aligned, to respective rotating rings, (c) holding the cam members on projections thereof with holding means attached to the rotating rings, (d) rotating the respective rings with the holding means a predetermined angle to give the cam members a predetermined angular relation to each other, (e) inserting a pipe member having opposite ends through the holes of the cam members, and (f) sealing the opposite ends of the pipe member, forcing pressurized fluid into the pipe member and fixing the cam members on the outer peripheral surface of the pipe member by a bulging process.

2. The method for manufacturing cam shafts as claimed in claim 1 wherein the steps of rotating the rotating rings by a predetermined angle comprises the steps of engaging gears on the outer peripheries of the rings with racks, and moving the racks by respective predetermined distances.

3. The method for manufacturing cam shafts as claimed in claim 1 wherein the holes of the cam members are grooved.

4. A method as in claim 1, wherein the respective rotating means are aligned in an axial direction and the step of conveying includes the step of inserting a rod in the axial direction through the holes of the cam members and conveying the cam members on the rod.

5. A method as in claim 1, wherein the step of holding comprises the step of holding the cam members in generally V-shaped recesses of holding members of the holding means.

6. An apparatus for manufacturing cam shafts, comprising:

a plurality of rotatable rings;

holding means, connected within said rotatable rings, for holding respective cam members having respective projections, and holes within said rotatable rings with said holes in alignment so that a pipe member can be inserted through the respective aligned holes, said holding means being movable toward and away from the projections of the cam members to respectively hold and release the cam members;

means for individually rotating said rings so as to rotate the cam members held therein by respective predetermined angles; and bulging process means for sealing respective opposite ends of the pipe member when the pipe member is inserted through the aligned holes in the cam members held by the holding means, and forcing a pressurized fluid into the pipe so as to bulge the pipe member to fix the pipe member in the respective holes.

7. An apparatus as in claim 6, wherein the rings are aligned in the axial direction thereof, the apparatus further comprising feeding means for feeding the cam members into the respective rings to be held by said holding means, said feeding means including a rod, and first fluid cylinder means on one axial side of said rings for extending said rod in the axial direction into the holes in the cam members and moving the cam members in the axial direction into the respective rings.

8. An apparatus as in claim 7, wherein said rod has radial dimensions which are increasable for engaging with the cam members while the cam members are being moved thereby into the respective rings, and decreasable for releasing the cam members when the cam members have been moved into said rings.

9. An apparatus as in claim 7, further comprising means, disposed at an insertion position spaced from said feeding means in a direction transverse to said axial direction, for inserting the pipe member through the aligned holes in the cam members held by the holding means, a base, and second fluid cylinder means for moving said base transversely to said axial direction to the pipe member insertion position, said rings being disposed on said base so as to move with said base.

10. An apparatus as in claim 6, wherein said holding means includes opposing holding members having V-shaped recesses for holding respective cam members therebetween.

11. An apparatus for manufacturing cam shafts as claimed in claim 6 wherein said rotatable rings are placed on a base, and the base is connected to a rod of a fluid cylinder.

12. An apparatus for manufacturing cam shafts as claimed in claim 6 wherein said rotating means for the rotating rings and racks which engage with the gears, and each rack is slidably movable a desired distance.

* * * * *